US007845987B2

(12) United States Patent
Yamada et al.

(10) Patent No.: US 7,845,987 B2
(45) Date of Patent: Dec. 7, 2010

(54) ELECTRICAL CONNECTOR WITH PLUG CONNECTOR AND RECEPTACLE CONNECTOR

(75) Inventors: Akio Yamada, Tokyo (JP); Isao Kojima, Tokyo (JP)

(73) Assignee: DDK Ltd., Tokyo (JP)

( * ) Notice: Subject to any disclaimer, the term of this patent is extended or adjusted under 35 U.S.C. 154(b) by 304 days.

(21) Appl. No.: 12/088,852

(22) PCT Filed: Sep. 15, 2006

(86) PCT No.: PCT/JP2006/318798

§ 371 (c)(1),
(2), (4) Date: Mar. 31, 2008

(87) PCT Pub. No.: WO2007/063636

PCT Pub. Date: Jun. 7, 2007

(65) Prior Publication Data

US 2010/0190383 A1 Jul. 29, 2010

(30) Foreign Application Priority Data

Dec. 1, 2005 (JP) ..... 2005-347973

(51) Int. Cl.
*H01R 13/64* (2006.01)

(52) U.S. Cl. ..... 439/680; 439/74

(58) Field of Classification Search ..... 439/660, 439/680, 74

See application file for complete search history.

(56) References Cited

U.S. PATENT DOCUMENTS 5,876,217 A * 3/1999 Ito et al. ..... 439/74
6,250,935 B1 * 6/2001 Mochizuki et al. ..... 439/74
6,729,890 B2 * 5/2004 Shin ..... 439/74
6,902,411 B2 * 6/2005 Kubo ..... 439/74
7,037,117 B2 * 5/2006 Goto ..... 439/74
7,128,581 B2 * 10/2006 Igarashi et al. ..... 439/74
7,195,495 B2 * 3/2007 Takano et al. ..... 439/74

FOREIGN PATENT DOCUMENTS

JP H-5-69873 A 9/1993
JP 10-162913 A 6/1998
JP 2002-8753 A 1/2002
JP 2005-19144 A 1/2005
JP 2005-50702 A 2/2005

* cited by examiner

*Primary Examiner*—Michael C Zarroli
(74) *Attorney, Agent, or Firm*—Sughrue Mion, PLLC

(57) ABSTRACT

The plug connector includes contacts and a block. The contacts are arranged on both sides of the block, and the block is formed at longitudinal ends with projection walls. The receptacle connector includes contacts and a housing. The contacts are arranged on both sides of the block to be opposite to each other in the width direction, and the housing is provided with engaging protrusions engaging the anchoring recess. The housing is further provided between the contacts longitudinally arranged with side walls A higher than upper surfaces of elastic portions of the contacts and with side walls B continuous with the side walls A and higher than upper surfaces of contact portions of the contacts. The plug contacts and the receptacle contacts are brought into contact with each other only after the plug connector and the receptacle connector have been completely fitted with each other.

5 Claims, 5 Drawing Sheets

ELECTRICAL CONNECTOR WITH PLUG CONNECTOR AND RECEPTACLE CONNECTOR

TECHNICAL FIELD

The present invention relates to an electrical connector comprising a plug connector and a receptacle connector for use in electric and electronic appliances such as mobile phones and the like, and more particularly to an electrical connector which can achieve its reduced overall height without damage to respective contacts even if the plug and receptacle connectors are wrongly fitted in an oblique direction.

BACKGROUND ART

In general, in the case that substrates are intended to be connected to each other, two connectors (for example, a plug connector and a receptacle connector) are used. Said two connectors each mainly comprise a plurality of contacts (for example, plug contacts or receptacle contacts), and an insulator made of an electrically insulating material (for example, block or housing) for arranging and holding said contacts. Said two connectors are each connected to a substrate by soldering or the like. The contacts of one of said two connectors are exposed and extended from the insulator and would be deformed depending on some conditions of fitting of the two connectors.

The applicant of the present application has proposed in the past an electrical connector with a structure by which contacts are prevented from being deformed even when two connectors are obliquely fitted, in Japanese Utility Model Application Opened No. H5-69,873 (1993) (Patent literature 1).

According to ABSTRACT of the Japanese Utility Model Application Opened No. H5-69,873 (1993), a rectangular multipolar connector of the prior art is configured that the block of a plug is adapted to be fitted in the enclosure of a socket, so that when the plug is erroneously inserted into the socket in an oblique direction, contacts would be deformed. For the purpose of solving this problem, the block 50 of a socket is formed to be substantially rectangular block-shaped and is provided at its both ends with extensions 52 and 53 whose thicknesses are in a relation of the thickness d of the extensions 53>thickness c of the extensions 52. The enclosure of a plug is formed from two plate-shaped members 20 and 21, whose lengths are determined such that the plate-shaped member 20 is received between the extensions 52 of the block 50, while the plate-shaped member 21 is received between the extensions 53. The distance b between the plate-shaped members 20 and 21 is determined to an extent such that the block 50 except for the extensions 52 and 53 can be snugly fitted between the plate-shaped members 20 and 21. As a result of which, since the width a of the block 50 is larger than the distance b between the plate-shaped members 20 and 21, there cannot be any oblique insertion of the block 50. Moreover, since the lengths of the plate-shaped members 20 and 21 are different from each other, there is no longer any risk of the block and socket being erroneously fitted with each other.

Incidentally, claim of the Japanese Utility Model Application Opened No. H5-69,873 recites a connector comprising a plug connector having a base for holding and fixing a plurality of contacts, said base provided with an enclosure for protecting said contacts, and a socket connector having a base for holding and fixing a plurality of contacts, said base having a block formed with holes for accommodating said contacts, wherein said block of said socket connector is provided at left and right sides of its longitudinal ends with extensions different in thickness between them on both the left and right sides, and said enclosure of said plug connector has lengths adapted to the thicknesses of the extensions provided at the longitudinal ends of the block of said socket connector.

In recent years, on proceeding of miniaturization of electrical connectors, there is an increasing demand for effective reduction in distance between substrates to be connected. In other words, there is the increasing need to reduce the overall height of electrical connectors each comprising a plug connector and a receptacle connector to be fitted with each other. On the other hand, on progressing of the miniaturization of the electrical connectors, it becomes difficult to fit a plug connector into a receptacle connector and consequently plug and receptacle connectors would be frequently obliquely fitted with each other. The oblique fitting of the connectors results in deformation of contacts and hence defective or failed connection. Therefore, the applicant of the present application has proposed the structure as disclosed in the Patent Literature 1.

Moreover, as the result of the miniaturization and reduced overall height of connectors, the contacts are also miniaturized so that the contacts become likely to be deformed even at a touch.

Further, even if the requirement of reduced overall height of both the connectors may be fulfilled, this will be attended by a problem of poor contact pressure which does not comply with a requirement and results in defective or failed connection.

SUMMARY OF THE INVENTION

In view of such problems of the prior art, it is an object of the invention to provide an electrical connector which can achieve a reduced overall height of the fitted electric connector and at the same time can prevent an oblique fitting of plug and receptacle connectors of the electrical connector.

The above object can be achieved by the electric connector 10 according to the invention comprising a plug connector 20 and a receptacle connector 50 detachably fitted with each other, wherein said plug connector 20 comprises a plurality of plug contacts 24 each having a contact portion 26 adapted to contact a receptacle contact, a fixed portion 28 to be held by a block 22, and a connection portion 30 to be connected to a substrate; and the block 22 for arranging and holding said plug contacts 24 thereon; said plug contacts 24 being arranged on both sides of the block 22 to be opposite to each other in the width direction of the block 22, and said block 22 being formed at its both longitudinal ends with projection walls 32 whose height is higher than that of upper surfaces 38 of said plug contacts 24 and said block 22 being provided between said opposite plug contacts 24 with an anchoring recess 34 adapted to engage said receptacle connector 50, wherein said receptacle connector 50 comprises a plurality of receptacle contacts 54 each having a contact portion 56 adapted to contact said plug contact 24, an elastic portion 62, a fixed portion 58 to be held by a housing 52, and a connection portion 60 to be connected to a substrate; and the housing 52 for arranging and holding said receptacle contacts 54 thereon; said receptacle contacts 54 being arranged on both sides of the housing 52 to be opposite to each other in the width direction of the housing 52, said housing 52 being provided with an engaging protrusion 64 to engage said anchoring recess 34 and formed at its both longitudinal ends with protrusion walls 68 whose height is higher than that of upper surfaces 70 of the elastic portions of said receptacle contacts 54, and said housing 52 being further provided at both the longitudinal ends with engaging grooves 66 for receiving said projection walls 32, respectively, and provided between said receptacle contacts 54 longitudinally arranged with side walls A 69 whose height is higher than the upper surfaces 70 of the elastic portions of said receptacle contacts 54 and with side walls B 71 continuous with said side walls A 69, whose height is higher than that of upper surfaces 73 of the contact portions of said receptacle contacts 54, and wherein upon said plug connector 20 and said receptacle connector 50 being fitted with each other, said plug contacts 24 and said receptacle contacts 54 are brought into contact with each other only after said plug connector 20 and said receptacle connector 50 have been completely fitted with each other.

When said plug connector 20 is obliquely inserted into said receptacle connector 50, said projection walls 32 of said plug connector 20 contact said protrusion walls 68 of said receptacle connector 50, and said side walls A 69, or said engaging protrusion 64 and said side walls B 71 of said receptacle connector, thereby preventing any erroneous fitting of said plug and receptacle connectors 20 and 50 and preventing any deformation of said plug and receptacle contacts 24 and 54 by avoiding said block 22 and said housing 52 from contacting said receptacle contacts 54 and said plug contacts 24, respectively.

Moreover, the height of said projection walls 32 is 0.1 mm to 0.3 mm higher than that of the upper surfaces 38 of said plug contacts 24, while the heights of said protrusion walls 68 and said side walls A 69 are 0.02 mm to 0.1 mm higher than that of the upper surfaces 70 of the elastic portions of said receptacle contacts 54, and the height of said side walls B 71 is 0.02 mm to 0.1 mm higher than that of the upper surfaces 73 of the contact portions of said receptacle contacts 54, while the difference between the heights of said engaging protrusion 64 and the upper surfaces 73 of the contact portions of said receptacle contacts 54 is −0.2 mm to 0.3 mm. If the height of said projection walls 32 is higher than that of the upper surfaces 38 of said plug contacts 24 only by a value of less than 0.1 mm, the oblique fitting could not be prevented. If the height of said projection walls 32 is higher than that of the upper surfaces 38 of said plug contacts 24 by a value of more than 0.3 mm, a reduced overall height of the connector upon fitted cannot be achieved. If the heights of said protrusion walls 68 and said side walls A 69 are higher than that of the surfaces 70 of said elastic portions of said receptacle contacts 54 only by a value of less than 0.02 mm, the oblique fitting cannot be prevented and the deformation of the contacts cannot be avoided. If the heights of said protrusion walls 68 and said side walls A 69 are higher than that of the upper surfaces 70 of said elastic portions of said receptacle contacts 54 by a value of more than 0.1 mm, a reduced overall height of the connector upon fitted cannot be achieved. If the height of said side walls B 71 is higher than that of the upper surfaces 73 of the contact portions of said receptacle contacts 54 only by a value of less than 0.02 mm, the oblique fitting cannot be prevented and the deformation of the contacts cannot be avoided. If the height of said side walls B 71 is higher than that of the upper surfaces 73 of the contact portions of said receptacle contacts 54 by a value of more than 0.1 mm, a reduced overall height of the connector upon fitted cannot be achieved. If the height of said engaging protrusion 64 is higher than that of the upper surfaces 73 of the contact portions of said receptacle contact 54 by a value of less than −0.1 mm, the oblique fitting cannot be prevented and deformation of the contacts cannot be avoided. If the height of said engaging protrusion 64 is higher than that of the upper surfaces 73 of the contact portions of said receptacle contacts 54 by a value of more than 0.3 mm, a reduced overall height of the connector upon fitted cannot be achieved.

Further, said block 22 of said plug connector 20 is provided with engaging portions 42 at both lateral ends of the longitudinal ends of said block, and said housing 52 of said receptacle connector 50 is provided with recesses adapted to engage said engaging portions 42 and located on both sides in the width direction of the housing 52 in said engaging grooves 66, thereby upon fitting of said plug and receptacle connectors generating audible or tactile click by said engaging portions 42 getting into said recesses.

As can be seen from the above description, the electrical connector 10 according to the invention brings about significant effects as follows.

(1) In an electrical connector 10 comprising a plug connector 20 and a receptacle connector 50 detachably fitted with each other, the electrical connector 10 according to the invention is constructed that the plug connector 20 comprises a plurality of plug contacts 24 each having a contact portion 26 adapted to contact a receptacle contact, a fixed portion 28 to be held by a block 22, and a connection portion 30 to be connected to a substrate; and the block 22 for arranging and holding said plug contacts 24 thereon; said plug contacts 24 being arranged on both sides of the block 22 to be opposite to each other in the width direction of the block 22, and said block 22 being formed at both longitudinal ends with projection walls 32 whose height is higher than that of upper surfaces 38 of said plug contacts 24 and said block 22 being provided between said opposite plug contacts 24 with an anchoring recess 34 adapted to engage said receptacle connector 50, that said receptacle connector 50 comprises a plurality of receptacle contacts 54 each having a contact portion 56 adapted to contact said plug contact 24, an elastic portion 62, a fixed portion 58 to be held by a housing 52, and a connection portion 60 to be connected to a substrate; and the housing 52 for arranging and holding said receptacle contacts 54 thereon; said receptacle contacts 54 being arranged on both sides of the housing 52 to be opposite to each other in the width direction of the housing 52, said housing 52 being provided with an engaging protrusion 64 to engage said anchoring recess 34 and formed at both longitudinal ends with protrusion walls 68 whose height is higher than that of upper surfaces 70 of the elastic portions of said receptacle contacts 54, and said housing 52 being further provided at both the longitudinal ends with engaging grooves 66 for receiving said projection walls 32, respectively, and provided between said receptacle contacts 54 longitudinally arranged with side walls A 69 whose height is higher than the upper surfaces 70 of the elastic portions of said receptacle contacts 54 and with side walls B 71 continuous with said side walls A 69, whose height is higher than that of upper surfaces 73 of the contact portions of said receptacle contacts 54, and that upon said plug connector 20 and said receptacle connector 50 being fitted with each other, said plug contacts 24 and said receptacle contacts 54 are brought into contact with each other only after said plug connector 20 and said receptacle connector 50 have been completely fitted with each other. Therefore, it is possible to obtain the electrical connector 10 which is less than 1.0 mm in overall height when the plug and receptacle connectors have been fitted, and the electrical connector 10 enables the plug and receptacle connectors to be accurately fitted with each other without being obliquely fitted and without any deformation of both the contacts 24 and 25, thereby achieving stable electrical connection.

(2) According to the invention, when said plug connector 20 is obliquely inserted into said receptacle connector 50, said projection walls 32 of said plug connector 20 contact said protrusion walls 68, and said side walls A 69, or said engaging protrusion 64 and said side walls B 71 of said receptacle connector, thereby preventing any erroneous fitting of said plug and receptacle connectors 20 and 50 and preventing any deformation of said plug and receptacle contacts 24 and 54 by avoiding said block 22 and said housing 52 from contacting said receptacle contacts 54 and said plug contacts 24, respectively. Consequently, it is possible to obtain the electrical connector 10 which is less than 1.0 mm in overall height when the plug and receptacle connectors have been fitted, and the electrical connector 10 enables the plug and receptacle connectors to be accurately fitted with each other without being obliquely fitted and without any deformation of both the contacts 24 and 25, thereby achieving stable electrical connection.

(3) According to the invention, the height of said projection walls 32 is 0.1 mm to 0.3 mm higher than that of the upper surfaces 38 of said plug contacts 24, while the heights of said protrusion walls 68 and said side walls A 69 are 0.02 mm to 0.1 mm higher than that of the upper surfaces 70 of the elastic portions of said receptacle contacts 54, and the height of said side walls B 71 is 0.02 mm to 0.1 mm higher than that of the upper surfaces 73 of the contact portions of said receptacle contacts 54, while the difference between the heights of said engaging protrusion 64 and the upper surfaces 73 of the contact portions of said receptacle contacts 54 is −0.2 mm to 0.3 mm. Therefore, it is possible to obtain the electrical connector 10 which is less than 1.0 mm in overall height when plug and receptacle connectors have been fitted, and the electrical connector 10 enables the plug and receptacle connectors to be accurately fitted with each other without being obliquely fitted and without any deformation of both the contacts 24 and 25, thereby achieving stable electrical connection.

(4) According to the invention, said block 22 of said plug connector 20 is provided with engaging portions 42 at both lateral ends of the longitudinal ends of said block, and said housing 52 of said receptacle connector 50 is provided with recesses adapted to engage said engaging portions 42 and located on both sides in the width direction of the housing 52 in said engaging grooves 66, thereby upon fitting of said plug and receptacle connectors generating audible or tactile click by said engaging portions 42 getting into said recesses. Consequently, it is possible to readily ascertain that said plug connector 20 and the receptacle connector 50 have been completely fitted.

DESCRIPTION OF THE REFERENCE NUMERALS

Figure 1A:
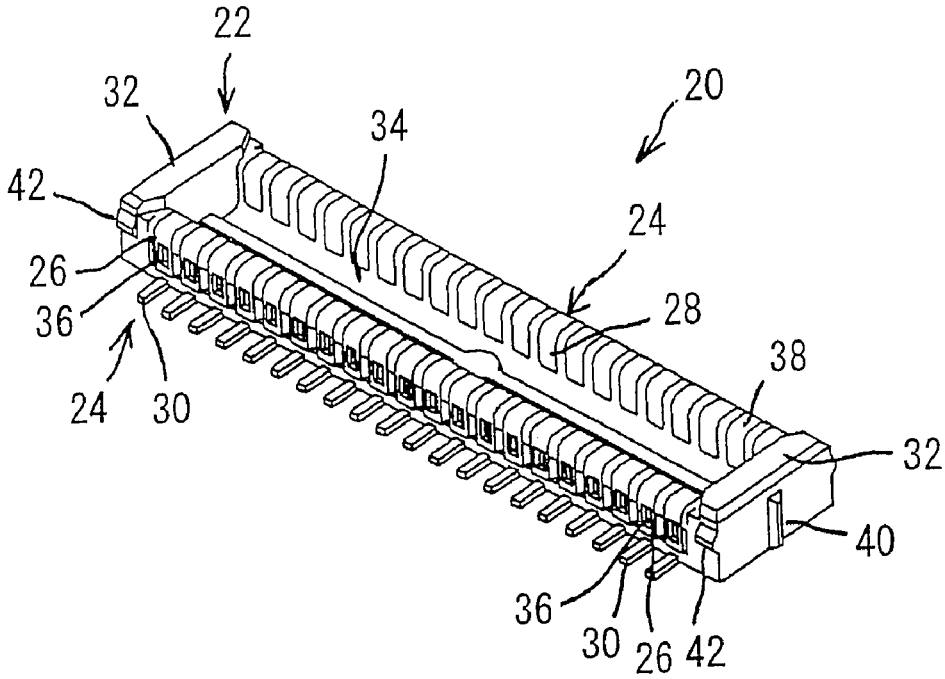
FIG. 1A is a perspective view of a plug connector according to the invention viewed from its fitting opening side.

10 Electrical connector
12 Fitting opening
20 Plug connector
22 Block
24 Plug contact
26, 56 Contact portion
28, 58 Fixed portion
30, 60 Connection portion
32 Projection wall
34 Anchoring recess
36 Recess
38 Upper surface
40 Rib
42 Engaging portion
50 Receptacle connector
52 Housing
54 Receptacle contact
62 Elastic portion
64 Engaging protrusion
66 Engaging groove
68 Protrusion wall
69 Side wall A
70 Upper surface of the elastic portion
71 Side wall B
72 Anchoring portion
73 Upper surface of the contact portion
74 Inserting groove

BEST MODE FOR CARRYING OUT THE INVENTION

Figure 1B:
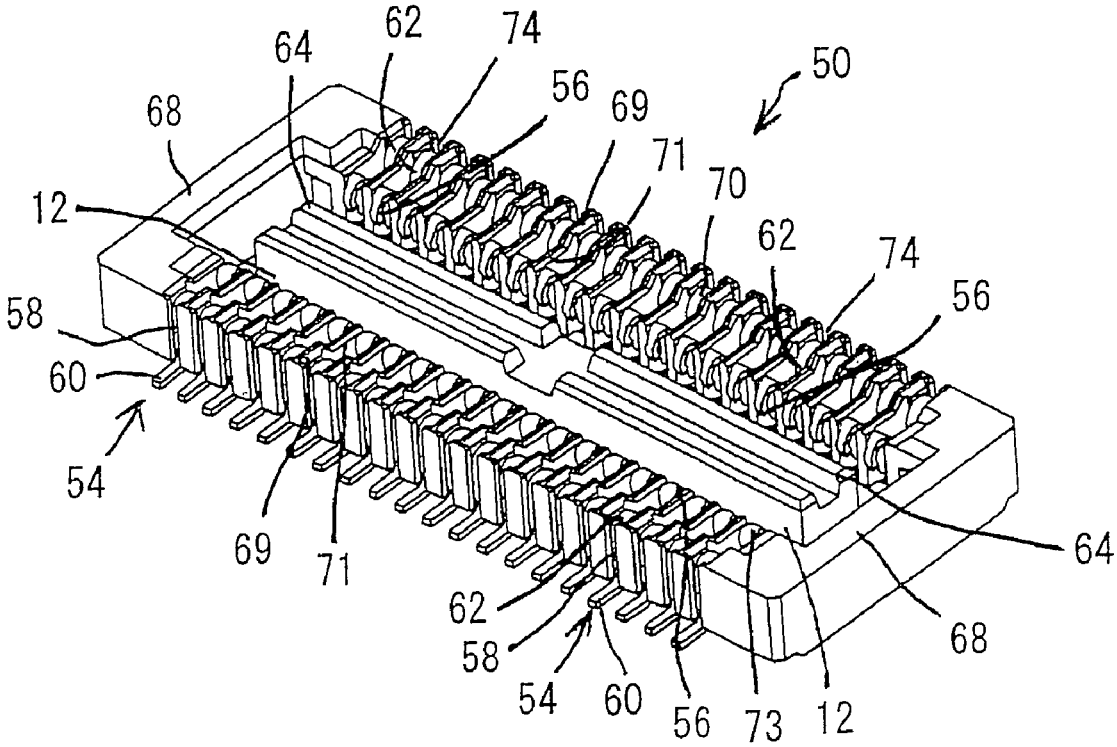
FIG. 1B is a perspective view of a receptacle connector according to the invention viewed from the fitting side.
Figure 2A:
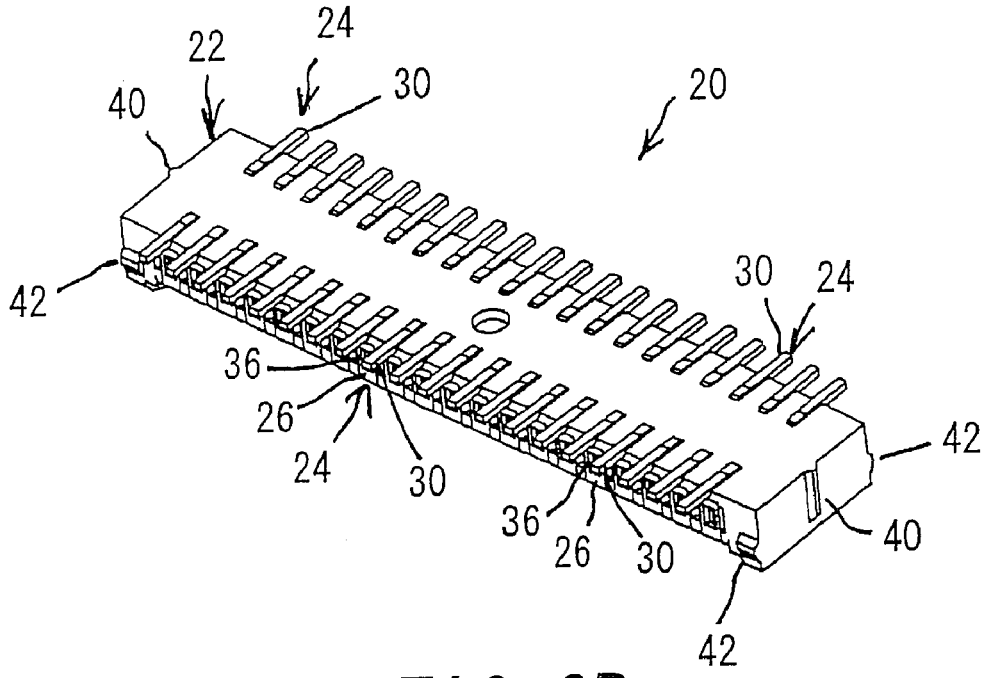
FIG. 2A is a perspective view of the plug connector according to the invention viewed from the side to be connected to a substrate.
Figure 2B:
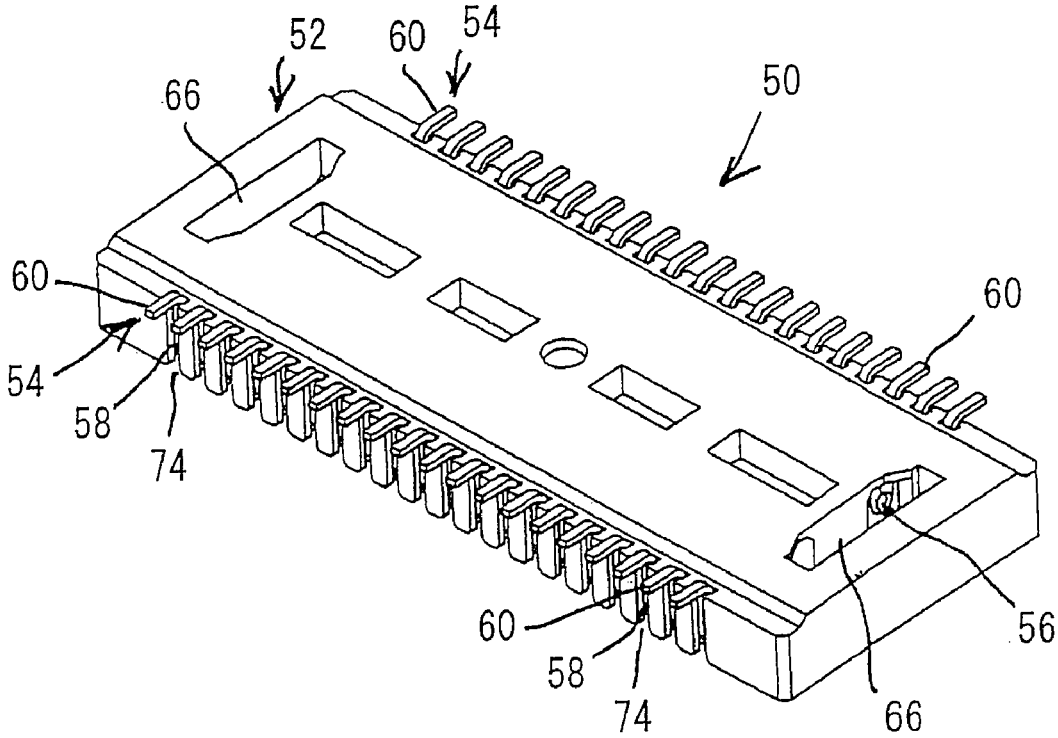
FIG. 2B is a perspective view of the receptacle connector according to the invention viewed from the side to be connected to a substrate.
Figure 3:
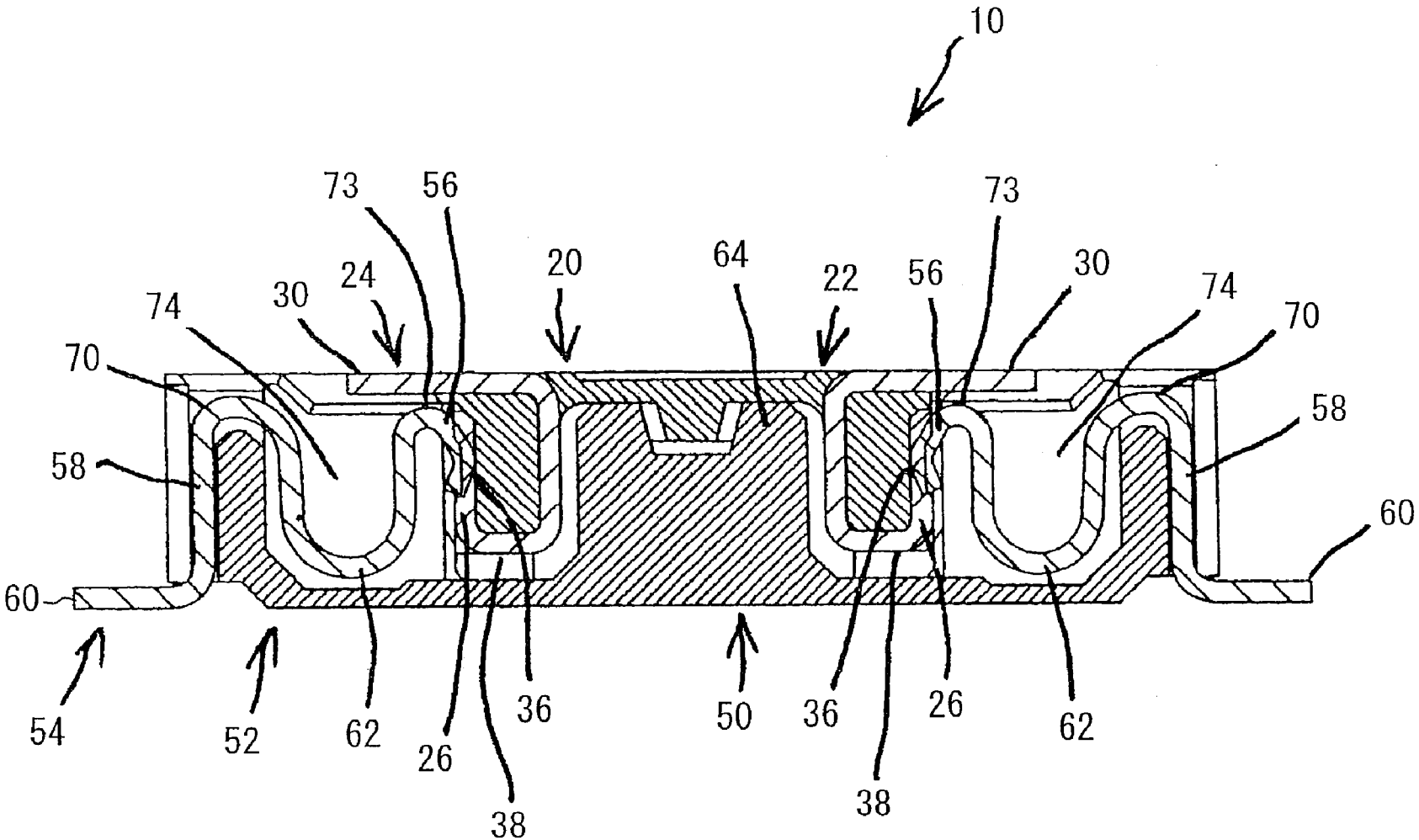
FIG. 3 is a sectional view of the plug and receptacle connectors under a condition of fitted with each other taken along some contacts.
Figure 4A:
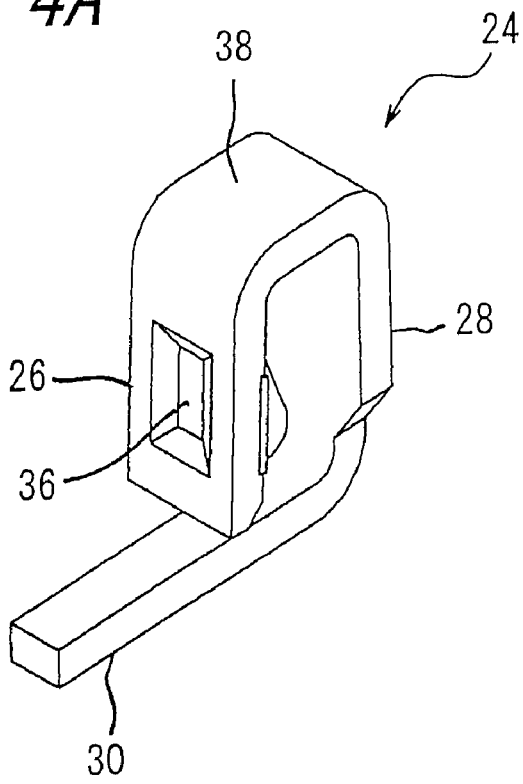
FIG. 4A is a perspective view of a plug contact.
Figure 4B:
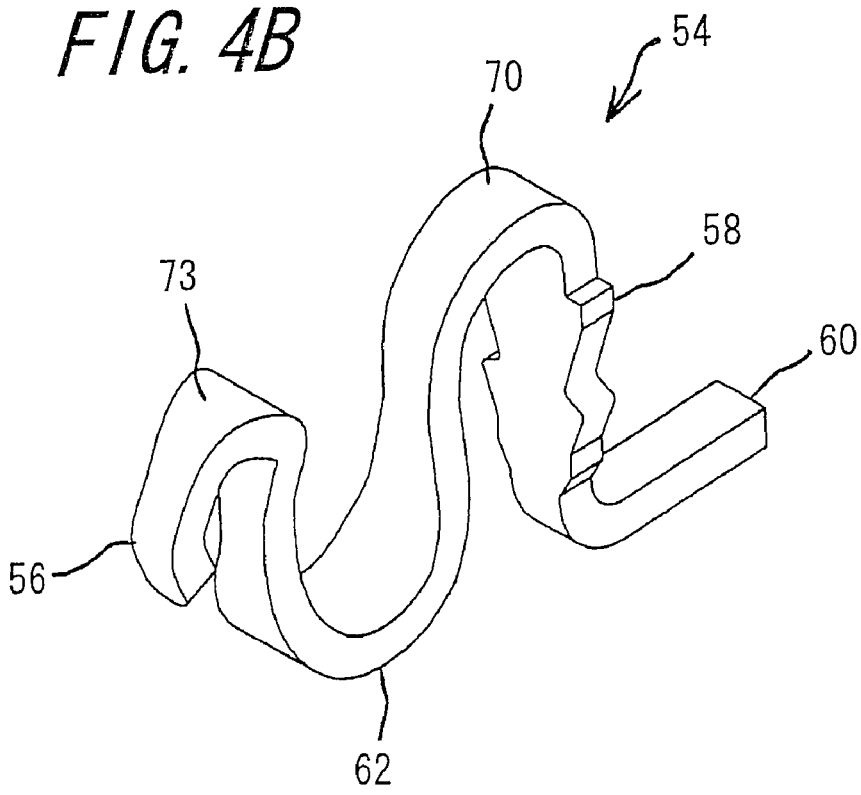
FIG. 4B is a perspective view of a receptacle contact.
Figure 5A:
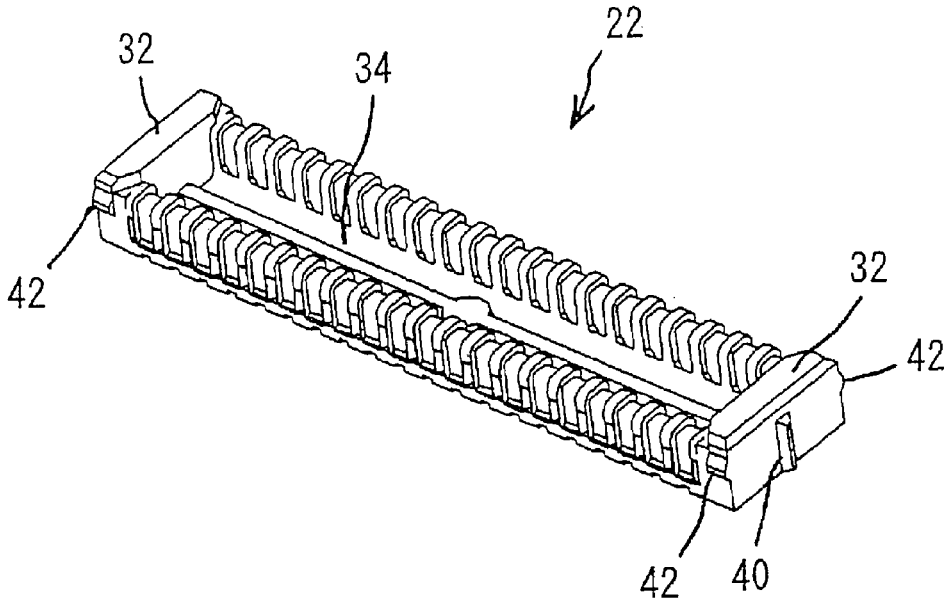
FIG. 5A is a perspective view of the block of the plug connector.
Figure 5B:
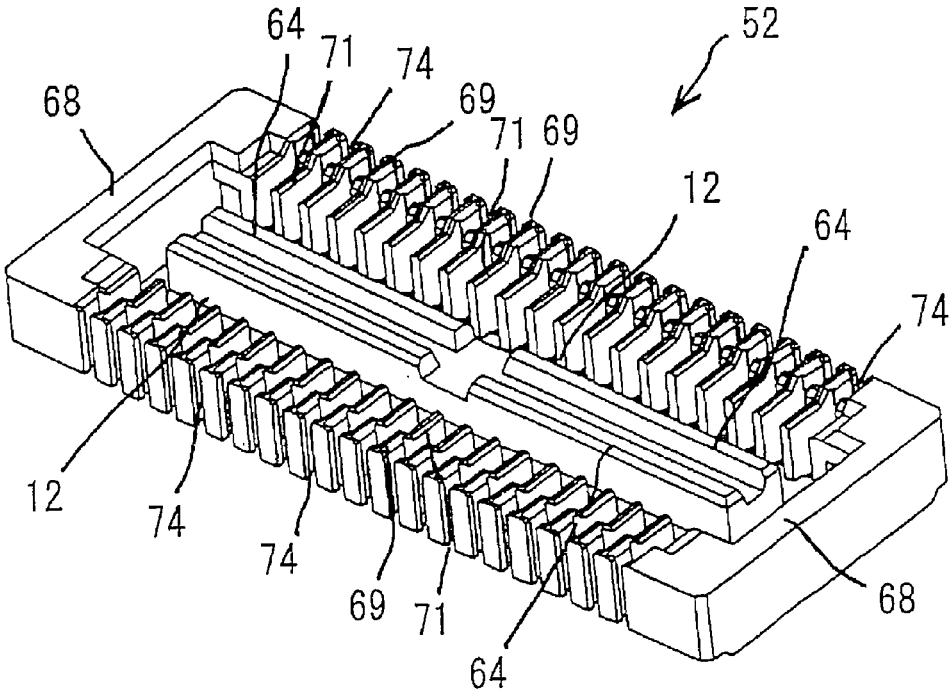
FIG. 5B is a perspective view of the housing of the receptacle connector.

One embodiment of the electrical connector 10 according to the invention will be explained with reference to FIGS. 1 to 5. FIG. 1A is a perspective view of a plug connector according to the invention viewed from its fitting opening side, and FIG. 1B is a perspective view of a receptacle connector according to the invention viewed from its fitting side. FIG. 2A is a perspective view of the plug connector according to the invention viewed from the side to be connected to a substrate, while FIG. 2B is a perspective view of the receptacle connector according to the invention viewed from the side to be connected to a substrate. FIG. 3 is a sectional view of the plug and receptacle connectors under a fitted condition to each other taken along some contacts. FIG. 4A is a perspective view of a plug contact, and FIG. 4B is a perspective view of a receptacle contact. FIG. 5A is a perspective view of the block of the plug connector, while FIG. 5B is a perspective view of the housing of the receptacle connector.

The electrical connector 10 according to the invention comprises the plug connector 20 and the receptacle connector 50, the former having the block 22 and the plug contacts 24 and the latter having the housing 52 and the receptacle contacts 54.

As described in the explanation of the prior art, the plug connector 20 and the receptacle connector 50 are each connected to respective substrate by soldering, and said plug connector 20 and said receptacle connector 50 are fitted with each other so that the respective substrates are electrically connected to each other, thereby enabling the exchange of signals between the substrates.

Respective components of the plug and receptacle connectors according to the invention will be explained with reference to drawings.

First, the parts of said plug connector 20 will be explained. At the beginning, the plug contacts 24 will be explained. The plug contacts 24 are made of a metal and formed by means of the press-working of the known technique. Preferred metals from which to form said plug contacts 24 include brass, beryllium copper, phosphor bronze and the like which comply with the requirements such as springiness, electric conductivity and the like.

As shown in FIG. 4A, said plug contact 24 is cross-sectionally substantially box-shaped. Said plug contact 24 includes a contact portion 26 at one end adapted to contact said receptacle contact 54, a fixed portion 28 to be fixed to said block 22, and a connection portion 30 at the other end to be connected to a substrate. Said plug contacts 24 are arranged along longitudinal edges of said block 22 on both the sides to be opposite to each other in the width direction of the block. Said plug contacts 24 are fixed to said block 22 by press-fitting, integral molding (molding the block together with the plug contacts previously arranged in a mold), welding or the like. The plug contacts are fixed to the block by integral molding in the illustrated embodiment. Although said connection portions 30 are of a surface mounting type (SMT) in the illustrated embodiment, they may be of a dip type. Said contact portion 26 is formed with a recess 36 so that when said plug connector 20 and said receptacle connector 50 are fitted with each other, the plug contacts 24 and the receptacle contacts 54 cooperate with each other to generate audible click or tactile click, and at the same time their contact ability can be improved.

The block 22 will then be explained. The block 22 for fixing the plug contacts is formed from an electrically insulating plastic material by means of the injection molding of the known technique. The materials suitable for the block 22 may be selected in consideration of dimensional stability, workability, manufacturing cost and the like and in general include polybutylene terephthalate (PBT), polyamide (66PA or 46PA), liquid crystal polymer (LCP), polycarbonate (PC) and the like and combination thereof.

As shown in FIG. 5A, said block 22 is formed on its longitudinal ends with projection walls 32 extending higher than the upper surfaces 38 of said plug contacts 24. The height of said projection walls 32 may be suitably designed in consideration of the trend in reduced overall height of connectors and prevention of oblique fitting. The structure for preventing the oblique fitting will be explained when all the parts have been explained. The height of said projection walls 32 is 0.1 mm to 0.2 mm higher than the upper surfaces 38 of said plug contacts 24. If the height of said projection walls 32 is higher than the upper surfaces 38 of said plug contacts 24 only by a value of less than 0.1 mm, the oblique fitting could not be prevented. On the other hand, if the value is more than 0.2 mm, it may provide an impediment to the reduced overall height of the connector 10 upon being fitted.

Said block 22 is provided with an anchoring recess 34 between said opposite plug contacts 24 for anchoring the plug connector 22 to said receptacle connector 50, an engaging protrusion 64 of said receptacle connector 50 being fitted in said anchoring recess 34. The size of said anchoring recess 34 may be suitably designed so as to receive said engaging protrusion 64 and in consideration of the miniaturization of the connector and contact stability.

Moreover, as shown in FIG. 5A, said block 22 is provided with ribs 40 at its longitudinal ends. When said plug connector 20 and said receptacle connector 50 are fitted with each other, the ribs 40 serve to improve positioning of these connectors for ensuring the accurate contact between said plug contacts 24 and said receptacle contacts 54 and to increase the fitting holding force of the connectors. The ribs 40 are formed to provide press-fitting with a slight interference between said plug connector 20 and said receptacle connector 50 in the illustrated embodiment. Furthermore, the block 22 is provided with engaging portions 42 at both lateral ends of the longitudinal ends of the block 22. The engaging portions 42 also serve to improve the holding force between said plug connector 20 and said receptacle connector 50 upon fitting with each other. Moreover, the bottom of said anchoring recess is provided with a ridge for the purpose of increasing the strength of said block 22 and improving the flowability of the block when being molded.

The parts of said receptacle connector 50 will then be explained. At the beginning, the receptacle contacts 54 will be explained. The receptacle contacts 54 are made of a metal and formed by means of the press-working of the known technique. Preferred metals from which to form said receptacle contacts 54 include brass, beryllium copper, phosphor bronze and the like which comply with the requirements such as springiness, electric conductivity and the like.

As shown in FIG. 4B, said receptacle contact 54 is cross-sectionally substantially inverted W-shaped and includes a contact portion 56 at one end adapted to contact said plug contact 24, and a connection portion 60 at the other end to be connected to a substrate, and further includes, between said contact portion 56 and said connection portion 60, an elastic portion 62 and a fixed portion 58 to be fixed to said housing 52. These portions of the receptacle contacts are arranged from the one end in the order of the contact portion 56, the elastic portion 62, the fixed portion 58 and the connection portion 60. Said receptacle contacts 54 are arranged along longitudinal edges of said housing 52 on both the sides to be opposite to each other in the width direction of the housing 52. The receptacle contacts 54 are fixed to the housing 52 by press-fitting, welding or the like and are fixed by press-fitting in the illustrated embodiment. Although the connection portions 60 are of a surface mounting type (SMT) in the illustrated embodiment, they may be of a dip type.

The contact portion 56 of said receptacle contact 54 is curved so that the contact portion 56 easily engages the recess 36 of said plug contact 24.

Moreover, between said contact portion 56 and said fixed portion 58, the elastic portion 62 is provided to obtain an elasticity over a certain length in order to ensure a stable contact between the plug and receptacle contacts upon fitting the plug and receptacle connectors. Said elastic portion 62 may be suitably designed to fulfil such a role, and the elastic portion 62 is curved once in the illustrated embodiment.

Said housing 52 will then be explained. The housing 52 is formed from an electrically insulating plastic material by means of the injection molding of the known technique. The materials suitable for the housing 52 may be selected in consideration of dimensional stability, workability, manufacturing cost and the like and in general include polybutylene terephthalate (PBT), polyamide (66PA or 46PA), liquid crystal polymer (LCP), polycarbonate (PC) and the like and combination thereof.

As shown in FIG. 5B, said housing 52 is substantially box-shaped. Said housing 52 is provided with an engaging protrusion 64 adapted to engage said anchoring recess 34 of said block 22 and located between said receptacle contacts 54 arranged along the longitudinal edges of the housing 52 to be opposite to each other on both the sides in its width direction. Positioning both the connectors 20 and 50 is achieved by the abutment of the bottom of said anchoring recess 34 against said engaging protrusion 64 upon fitting of the connectors 20 and 50. The size of said engaging protrusion 64 may be suitably designed in consideration of the miniaturization and strength of the connector, contact stability of the contacts and the like. Moreover, said engaging protrusion 64 is formed in its top surface with relief grooves for preventing the ridge of the block 22 of said plug connector 20 from touching the top of said engaging protrusion 64.

Said housing 52 is further formed with engaging grooves 66 for receiving said projection walls 32 of said plug connector 20. The positions and sizes of said engaging grooves 66 may be suitably designed so as to receive the projection walls 32 of said plug connector 20 and in consideration of the reduced overall height of the connector, the strength of the housing 52 and the like. The engaging grooves 66 are through-holes in consideration of the reduced overall height in the illustrated embodiment.

The housing 52 is formed with protrusion walls 68 at the longitudinal ends and further formed with the engaging grooves 66 also at the longitudinal ends for receiving said projection walls 32. The height of said protrusion walls 68 is higher than that of the upper surfaces 70 of the elastic portions of said receptacle contacts 54.

The housing 52 is further formed with side walls A 69 higher than the upper surfaces 70 of the elastic portions of said receptacle contacts 54 and located between said receptacle contacts 54 longitudinally arranged and the housing 52 is further formed with side walls B 71 continuous with said side walls A 69 and higher than the upper surfaces 73 of the contact portions of said receptacle contacts 54.

The height of said projection walls 32 is 0.1 mm to 0.3 mm higher than the upper surfaces 38 of the plug contacts 24, and the heights of said protrusion walls 68 and said side walls A 69 are 0.02 mm to 0.11 mm higher than that of upper surfaces 70 of said elastic portions of said receptacle contacts 54. The height of said side walls B 71 is 0.02 mm to 0.1 mm higher than the upper surfaces 73 of the contact portions of said receptacle contacts 54, while the difference between the heights of said engaging protrusion 64 and the upper surfaces 73 of the contact portions of said receptacle contacts 54 is −0.2 mm to 0.3 mm. With the difference between the heights of said engaging protrusion 64 and the upper surfaces 73 of the contact portions of said receptacle contacts 54, it is preferable that the height of said engaging protrusion 64 is somewhat higher than that of the upper surfaces 73 of the contact portions of said receptacle contacts from the standpoint of prevention of oblique fitting and avoidance of deformation of the contacts. In other words, it is preferable that the height of said engaging protrusion 64 is higher than the upper surfaces 73 of the contact portions of said receptacle contacts 54 by a value of more than 0 mm. If the height of said projection walls 32 is higher than that of the upper surfaces 38 of said plug contacts 24 only by a value of less than 0.1 mm, the oblique fitting could not be prevented. If the height of said projection walls 32 is higher than that of the upper surfaces 38 of said plug contacts 24 by a value of more than 0.3 mm, a reduced overall height of the connector upon fitted cannot be achieved. If the heights of said protrusion walls 68 and said side walls A 69 are higher than that of the surfaces 70 of said elastic portions of said receptacle contacts 54 only by a value of less than 0.02 mm, the oblique fitting cannot be prevented and the deformation of the contacts cannot be avoided. If the heights of said protrusion walls 68 and said side walls A 69 are higher than that of the upper surfaces 70 of said elastic portions of said receptacle contacts 54 by a value of more than 0.1 mm, a reduced overall height of the connector upon fitted cannot be achieved. If the height of said side walls B 71 is higher than that of the upper surfaces 73 of the contact portions of said receptacle contacts 54 only by a value of less than 0.02 mm, the oblique fitting cannot be prevented and the deformation of the contacts cannot be avoided. If the height of said side walls B 71 is higher than that of the upper surfaces 73 of the contact portions of said receptacle contacts 54 by a value of more than 0.1 mm, a reduced overall height of the connector upon fitted cannot be achieved. If the height of said engaging protrusion 64 is higher than that of the upper surfaces 73 of the contact portions of said receptacle contact 54 by a value of less than −0.2 mm, the oblique fitting cannot be prevented and deformation of the contacts cannot be avoided. If the height of said engaging protrusion 64 is higher than that of the upper surfaces 73 of the contact portions of said receptacle contacts 54 by a value of more than 0.3 mm, a reduced overall height of the connector upon fitted cannot be achieved.

Moreover, said housing 52 is formed with recesses adapted to engage said engaging portions 42 and located in said engaging grooves 66 on both the sides in the width direction of the housing. When said plug connector 20 and said receptacle connector 50 are fitted with each other, said engaging portions 42 snap into said recesses to generate audible click or tactile click. The size and positions of said recesses may be of any ones insofar as they produce audible click or tactile click and may be suitably designed in consideration of a condition of click, strength and the like.

Finally, an oblique fitting preventing structure will be explained. When the plug and receptacle connectors are being fitted in oblique positions relative to each other, prior to the occurrence of contact between the plug and receptacle contacts, the projection walls 32 of said plug connector 20 will contact or abut against said protrusion walls 68 of said receptacle connector 50 and further the block 22 of the plug connector 20 will contact the side walls A 69, said engaging protrusion 64 and side walls B 71 of said receptacle connector 50, thereby preventing the oblique fitting of the plug and receptacle connectors.

INDUSTRIAL APPLICABILITY

Examples of applications of the invention are electrical connectors comprising plug and receptacle connectors 20 and 50 for use in electric and electronic appliances such as mobile phones and the like, and more particularly electrical connectors which can achieve a reduced overall height of connector without damage to respective contacts even if the plug and receptacle connectors 20 and 50 are wrongly being fitted in an oblique direction.

The invention claimed is:

1. An electrical connector comprising a plug connector and a receptacle connector detachably fitted with each other, wherein said plug connector comprises a plurality of plug contacts each having a contact portion adapted to contact a receptacle contact, a fixed portion to be held by a block, and a connection portion to be connected to a substrate; and the block for arranging and holding said plug contacts thereon; said plug contacts being arranged on both sides of the block to be opposite to each other in the width direction of the block, and said block being formed at both longitudinal ends with projection walls whose height is higher than that of upper surfaces of said plug contacts and said block being provided between said opposite plug contacts with an anchoring recess adapted to engage said receptacle connector, wherein said receptacle connector comprises a plurality of receptacle contacts each having a contact portion, adapted to contact said plug contact, an elastic portion, a fixed portion to be held by a housing, and a connection portion to be connected to a substrate; and the housing for arranging and holding said receptacle contacts thereon; said receptacle contacts being arranged on both sides of the housing to be opposite to each other in the width direction of the housing, said housing being provided with an engaging protrusion to engage said anchoring recess and formed at both longitudinal ends with protrusion walls whose height is higher than that of upper surfaces of the elastic portions of said receptacle contacts, and said housing being further provided at both the longitudinal ends with engaging grooves for receiving said projection walls, respectively, and provided between said receptacle contacts longitudinally arranged with side walls A whose height is higher than the upper surfaces of the elastic portions of said receptacle contacts and with side walls B continuous with said side walls A, whose height is higher than that of upper surfaces of the contact portions of said receptacle contacts, and wherein upon said plug connector and said receptacle connector being fitted with each other, said plug contacts and said receptacle contacts are engaged only after said plug connector and said receptacle connector have been completely fitted with each other.

2. The electrical connector as set forth in claim 1, wherein when said plug connector is obliquely inserted into said receptacle connector, said projection walls of said plug connector contact said protrusion walls, and said block of said plug connector contacts said side walls A, said engaging protrusion or said side walls B of said receptacle connector, thereby preventing any erroneous fitting of said plug and receptacle connectors and preventing any deformation of said plug and receptacle contacts by avoiding said block and said housing from contacting said receptacle contacts and said plug contacts, respectively.

3. The electrical connector as set forth in claim 1 or 2, wherein the height of said projection walls is 0.1 mm to 0.3 mm higher than that of the upper surfaces of said plug contacts, while the heights of said protrusion walls and said side walls A are 0.02 mm to 0.1 mm higher than that of the upper surfaces of the elastic portions of said receptacle contacts, and the height of said side walls B is 0.02 mm to 0.1 mm higher than that of the upper surfaces of the contact portions of said receptacle contacts, while the difference between the heights of said engaging protrusion and the upper surfaces of the contact portions of said receptacle contacts is −0.2 mm to 0.3 mm.

4. The electrical connector as set forth in claim 1 or 2, wherein said block of said plug connector is provided with engaging portions at both lateral ends of the longitudinal ends of said block, and said housing of said receptacle connector is provided with recesses adapted to engage said engaging portions and located on both sides in the width direction of the housing in said engaging grooves, thereby upon fitting of said plug and receptacle connectors generating audible or tactile click by said engaging portions getting into said recesses.

5. The electrical connector as set forth in claim 3, wherein said block of said plug connector is provided with engaging portions at both lateral ends of the longitudinal ends of said block, and said housing of said receptacle connector is provided with recesses adapted to engage said engaging portions and located on both sides in the width direction of the housing in said engaging grooves, thereby upon fitting of said plug and receptacle connectors generating audible or tactile click by said engaging portions getting into said recesses.

* * * * *